US012546188B2

(12) United States Patent
Calvis et al.

(10) Patent No.: US 12,546,188 B2
(45) Date of Patent: Feb. 10, 2026

(54) FLOATING VALVE ASSEMBLY FOR DRILL PIPES

(71) Applicants: Lorenzo Ernesto Pinto Calvis, Neuquen (AR); Carlos Daniel Llorens, Neuquen (AR); Pablo Gaston Gonzalez, Neuquen (AR); Pablo Alberto Perotti, Neuquen (AR)

(72) Inventors: Lorenzo Ernesto Pinto Calvis, Neuquen (AR); Carlos Daniel Llorens, Neuquen (AR); Pablo Gaston Gonzalez, Neuquen (AR); Pablo Alberto Perotti, Neuquen (AR)

( * ) Notice: Subject to any disclaimer, the term of this patent is extended or adjusted under 35 U.S.C. 154(b) by 0 days.

(21) Appl. No.: 18/853,752

(22) PCT Filed: May 19, 2023

(86) PCT No.: PCT/IB2023/055146

§ 371 (c)(1),
(2) Date: Oct. 3, 2024

(87) PCT Pub. No.: WO2024/013579

PCT Pub. Date: Jan. 18, 2024

(65) Prior Publication Data

US 2025/0230729 A1 Jul. 17, 2025

(30) Foreign Application Priority Data

Jul. 11, 2022 (AR) ..... P20220101816

(51) Int. Cl.
*E21B 34/10* (2006.01)

(52) U.S. Cl.
CPC ..... *E21B 34/10* (2013.01); *E21B 2200/05* (2020.05)

(58) Field of Classification Search
CPC ..... E21B 2200/05; E21B 34/102; E21B 21/10
See application file for complete search history.

(56) References Cited

U.S. PATENT DOCUMENTS

| | | | | |
|---|---|---|---|---|
| 1,631,509 | A | 6/1927 | Baker | |
| 1,984,107 | A | 12/1934 | Baker | |
| 2,750,958 | A | 6/1956 | Baker et al. | |
| 3,016,914 | A | 1/1962 | Keithahn | |
| 3,189,316 | A * | 6/1965 | Preston, Jr. | E21B 34/12 251/74 |
| 4,213,508 | A * | 7/1980 | Tschirky | E21B 34/063 137/72 |
| 4,270,569 | A * | 6/1981 | Reay | E21B 21/10 137/514.7 |
| 5,850,881 | A | 12/1998 | Rodger et al. | |
| 2004/0026091 | A1 | 2/2004 | Patel | |

(Continued)

FOREIGN PATENT DOCUMENTS

| | | |
|---|---|---|
| EP | 0250144 | 3/1993 |
| RU | 2632079 | 2/2017 |

*Primary Examiner* — Cathleen R Hutchins
(74) *Attorney, Agent, or Firm* — Defillo & Associates, Inc.; Evelyn A. Defillo

(57) ABSTRACT

A floating valve assembly for drill pipes (C). The circulation systems contain conventional and non-conventional oil and gas drilling fluids. The assembly includes a first member device (D1) of the piston or plunger type and a second member device (D2) of the swing check type, which are integrally connected in series and arranged vertically in tandem inside the pipe.

1 Claim, 6 Drawing Sheets

(56) References Cited

U.S. PATENT DOCUMENTS

| | | | | |
|---|---|---|---|---|
| 2006/0169465 | A1 | 8/2006 | Hejl et al. | |
| 2009/0065194 | A1 | 3/2009 | Fraizer | |
| 2020/0240236 | A1* | 7/2020 | Cress | E21B 34/06 |

* cited by examiner

FLOATING VALVE ASSEMBLY FOR DRILL PIPES

CROSS REFERENCE TO RELATED APPLICATION

This application is a national stage entry of PCT/IB2023/055146 filed May 19, 2023, under the International Convention and claiming priority over Argentina Patent Application No. P20220101816 filed Jul. 11, 2022.

FIELD OF THE INVENTION

This invention patent relates to a "Double Floating Valve Assembly for Drill Pipes," featuring dual closure and sealing effects, designed for use in the fluid circulation systems of drilling operations for oil and gas wells, both conventional and unconventional.

STATE OF THE ART

Piston float valves have long been used in oilfield drilling operations and are preferred over flapper valves in some applications due to their high reliability and long service life. Float valves are increasingly used, for example, in air drilling operations where a drill bit receives high-pressure air that passes through the drill string and the float valve.

A float valve is commonly installed within a housing body, called a float valve sub, which connects with a drill collar, known as the bit sub, of a tubular string via a specific drill thread. The float valve sub can be positioned between the threaded connections of the bit subs and is conventionally provided with male and female connections, called pin or box, for coupling and sealing with the drill pipe threads used by drilling rigs. The backpressure action of the valve prevents cuttings from entering the drill pipe and blocking circulation as additional joints are added to the drill string. The float valve opens when the drill pipe is raised out of the well, ensuring proper drainage of the drill pipe during tripping operations, thus conserving drilling fluids and keeping the rig floor relatively clean.

When placed inside the float valve housing sub, a float valve seals against the inner surface of the float valve sub body, providing a positive and instant shut-off of fluids that generate upward pressure as the depth of the well being drilled increases or during tool insertion operations. The float valve sub has a seat in the float valve housing where the valve rests. The float valve thus ensures fluid flow control through the drill pipe at all times.

Simple float valves for drill pipes, such as the BAKER piston-type valves, are known and demonstrated, for example, in patent publications U.S. Pat. Nos. 2,750,958 A, 1,984,107 A, 3,016,914 A, 1,631,509 A, and 5,850,881 A.

The identified problem: In the event of a failure of these known simple float valves of the BAKER type, they become functionally stuck and fail to achieve their purpose due to the presence of foreign bodies that prevent closure. They do not provide a positive and instant shut-off against high or low pressure, failing to ensure continuous fluid flow control during drilling and generating reverse fluid flow, thus posing a high risk of well control issues and emergencies during operations.

The proposed solution: A double-closure, anti-return floating valve assembly that includes two different retention devices, reducing the risk of failure and ensuring better fluid control. This double valve assembly comprises two combined member devices: a piston-type and a flapper-type, which are connected in series and arranged vertically in tandem within the float valve sub, connected to the drill pipe.

Additionally, it reduces the number of connections involved in assembling the Bottom Hole Assembly (BHA), improving the efficiency of assembling this drilling toolset and reducing the number of connectors (connections) present in it.

A particular feature focuses on the thread that allows the pieces to be joined or coupled; otherwise, manufacturing cannot proceed.

Another option could involve replacing with shear pins, J-type assembly, clamps, or other mechanisms that ensure the union of the parts.

OBJECTIVE OF THE INVENTION

An objective of this invention is to provide a "Double Floating Valve Assembly for Drill Pipes, with double interconnected closure devices," preventing operational failures and significantly extending service life.

These and other objectives, features, and advantages of the present invention will become apparent from the following detailed description, which references the accompanying drawings.

DETAILED DESCRIPTION OF THE INVENTION

The valve assembly is composed of the following components and their functionality:

C: Floating valve assembly

D1: First member device—piston or plunger.

D2: Second member device—flapper retention.

1. Piston or plunger body.
2. Flapper body.
3. Outer circular seals.
4. Flapper seat ring.
5. Ring.
6. Piston or plunger.
7. Disc.
8. Piston head ring.
9. Spring.
10. Bushing.
11. Flapper.
12. Roller.
13. Locking button.
14. Flapper spring.

15. Top locking button.
16. Bushing fork guide—piston guide, having a C-shape.
17. Male thread connecting member devices.
18. Female thread connecting member devices.
19. External circular seal housing grooves.
20. Inner seal.
21. Ring.

The proposed floating valve assembly, with its dual closure and sealing effect, is high-performing in practice and essential for constant fluid control during drilling.

This type of valve assembly is for downhole safety and prevents undesirable fluids from backflowing (anti-return) into the drill string whenever the rig changes connections (tripping operations).

Basic Principle of Operation

The basic operating principle of the double floating valve assembly is to allow fluid flow in one direction for extended periods without failure and retain fluids in the opposite direction, providing safety in conventional and unconventional oil and gas well operations.

Figure 1:
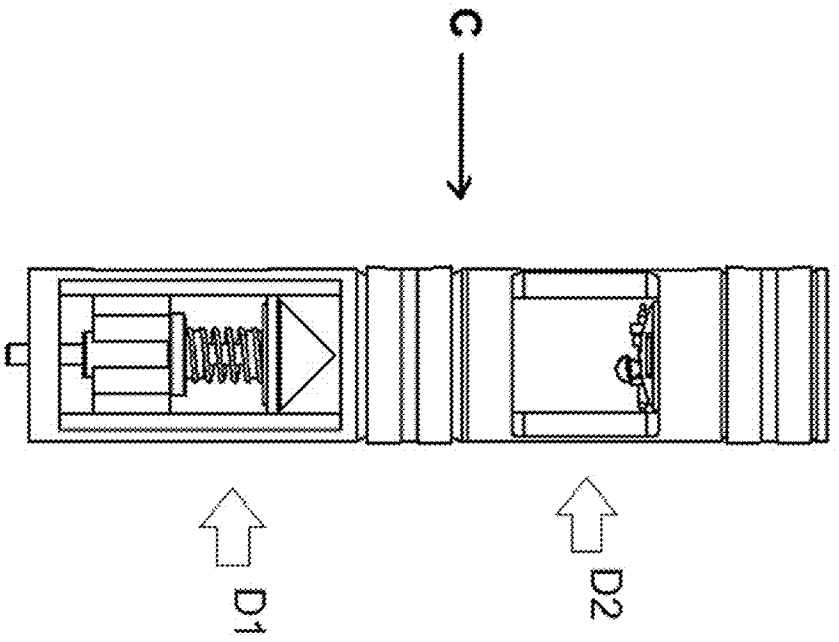
FIG. 1: A schematic perspective view of the floating valve assembly of the invention.
Figure 2:
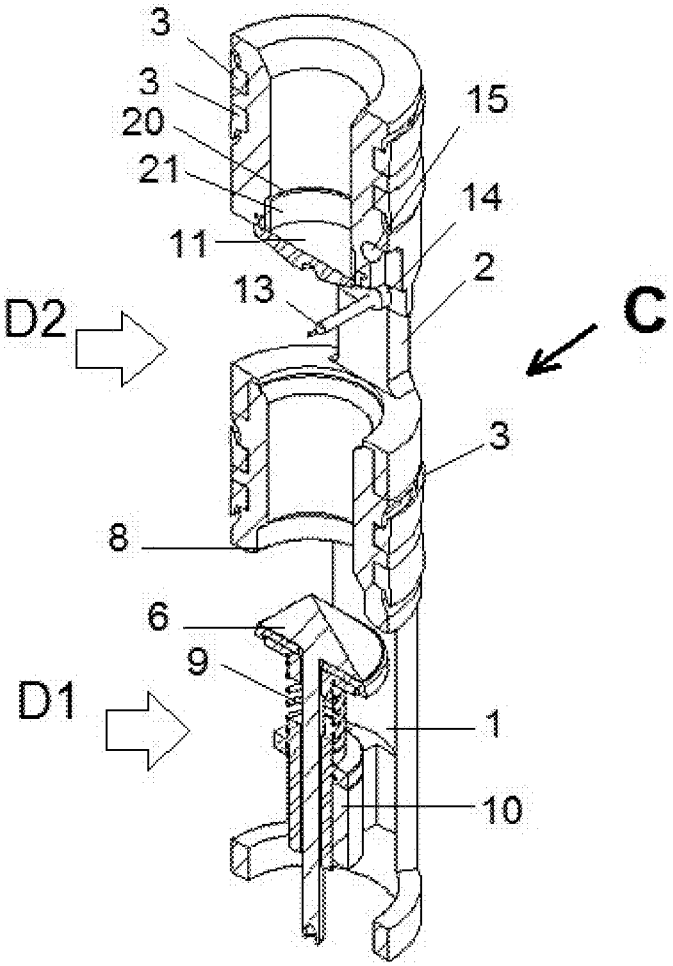
FIG. 2: A cross-sectional view of the double floating valve assembly.
Figure 3:
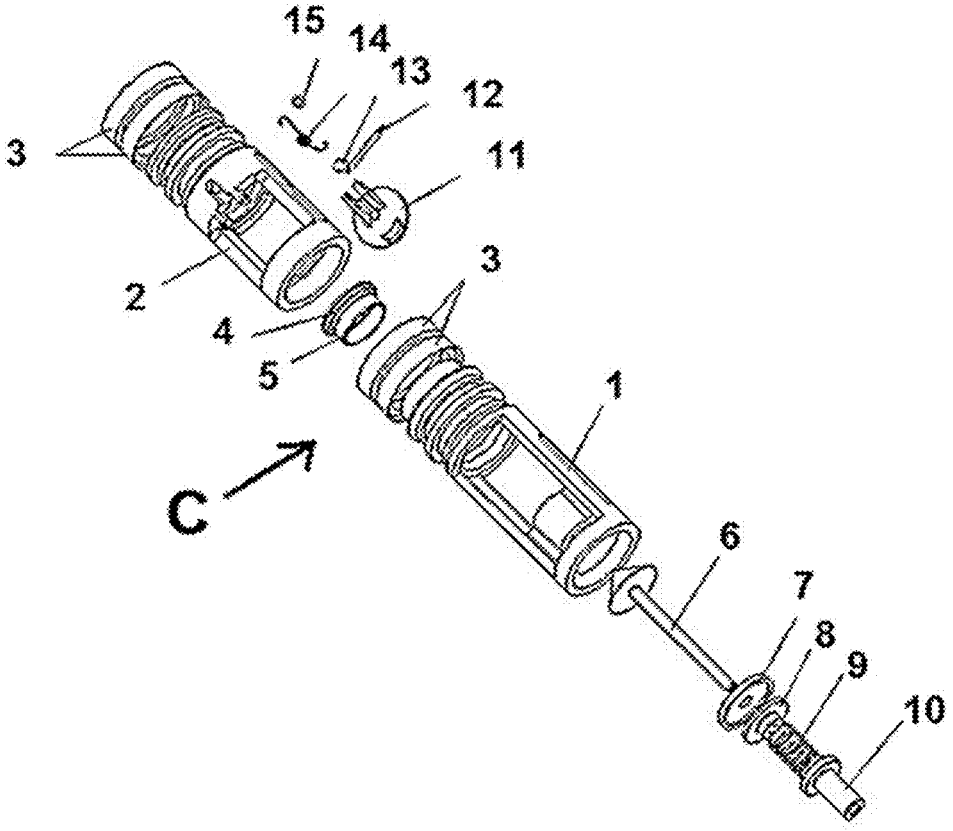
FIG. 3: An exploded view of the floating valve assembly of the invention.
Figure 4:
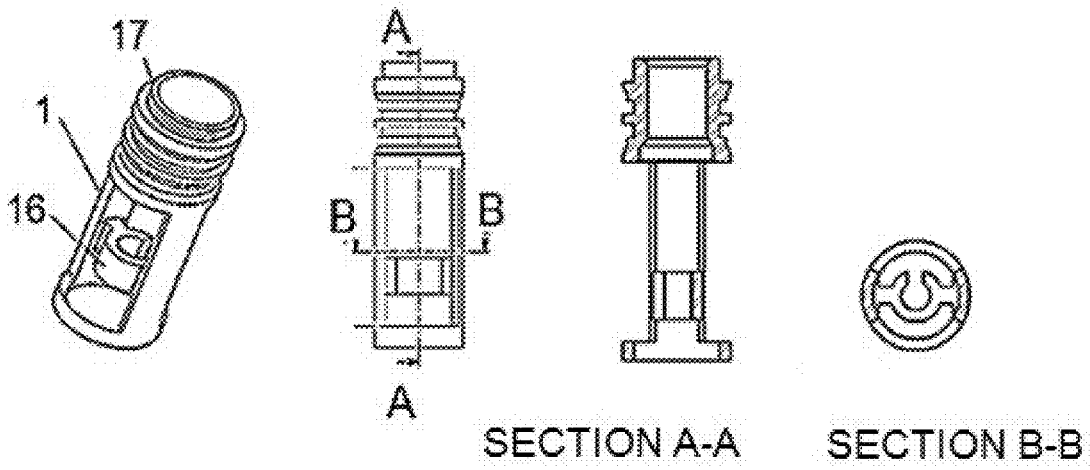
FIG. 4: Positional views in perspective, front, and cross-section of the technical features of the piston body (1), such as the threaded section, outer seal housing grooves, and piston guide fork.
Figure 5:
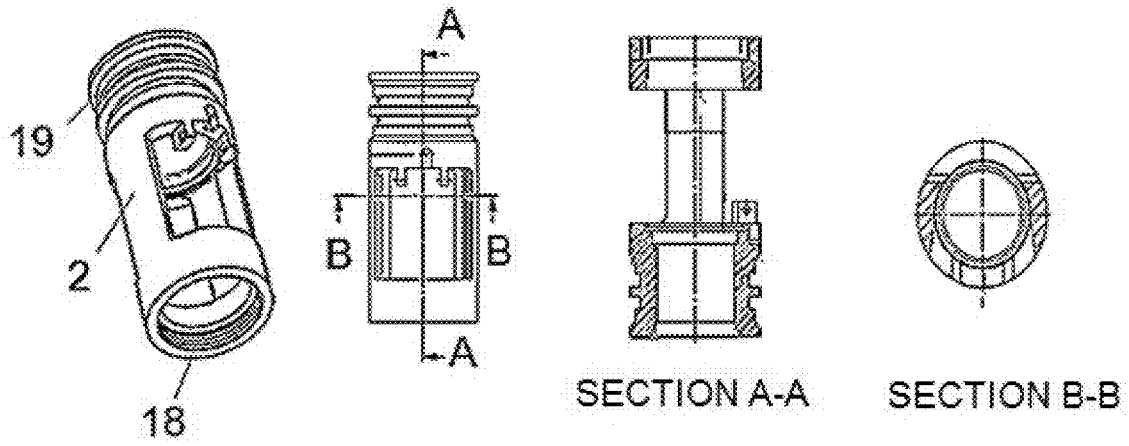
FIG. 5: Positional views in perspective, front, and cross-section of the technical features of the flapper body (2), such as the threaded section, outer seal housing grooves, flapper housing, and securing means.
Figure 6:
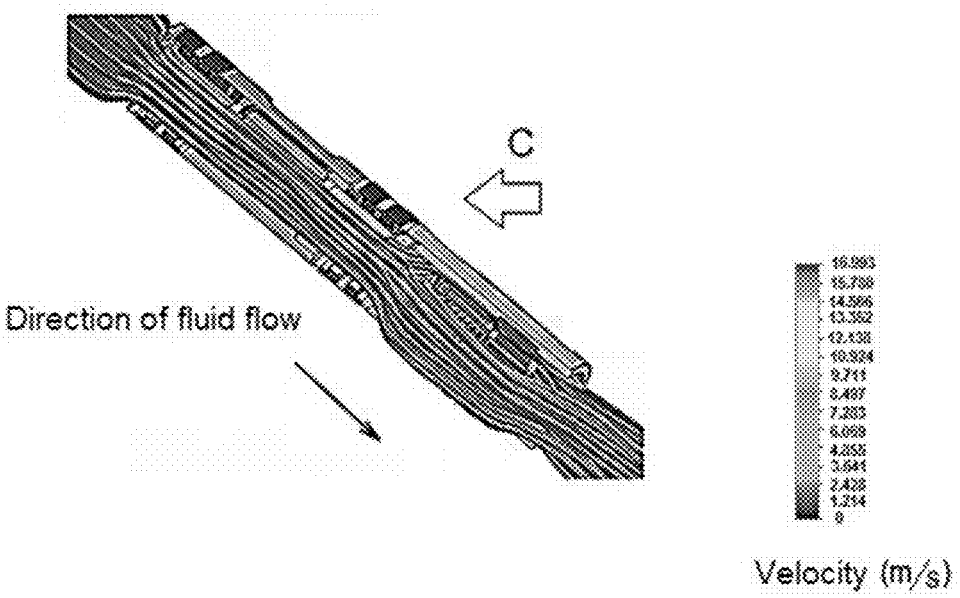
FIG. 6: A graph showing a circulation simulation proving the adequate performance of the valve assembly of the invention.

According to FIG. 6, the simulation conditions are:

FLOW RATE: 350 GPM.

1 GPM (gallon per minute)=0.22712470704 cubic meters per hour. 350 gal/m=79.4936 $m^3/h$

FLUID: WATER

DENSITY: 1.0 Kg/L

The reason for simulating with water is to use the lowest viscosity fluid to observe turbulence zones that might cause erosion or premature tool wear.

As can be seen, there are no significant impact zones for this design of the valve assembly of the invention.

Having described and determined the nature and scope of the present invention and the manner in which it is to be implemented, it is hereby claimed as invention and exclusive property.

The invention claimed is:

1. A floating valve assembly for a drill pipe having a double closure and a sealing effect, used in fluid circulation systems for conventional and unconventional oil and gas well drilling, the floating valve comprising:

a first member device including a body having a first end, a second end, and a piston or a plunger; and a second member device including a body having a first end, a second end, and a flapper retention device, wherein the first member device and the second member device are integrally connected in series and arranged vertically in tandem within the drill pipe;

a first set of outer circular seals located at the first end of the first member device;

a flapper seat ring and a ring connected to the first set of the outer circular seals and to the first end of the second member device;

a second set of outer circular seals located to the second end of the second member device;

wherein the first set of outer circular seals and the second set of circular seals are housed in grooves located on the first member device and the second member device;

wherein the flapper retention device includes a flapper, a roller, and a flapper spring;

wherein the first member device and the second member device are connected by a male thread and a female thread;

the first member device includes a fork having a C-shape, the fork serves as a bushing and piston guide, a disc for a piston head seat, a piston head ring, and a spring.

* * * * *